US006095362A

United States Patent [19]

Shui-Shang

[11] Patent Number: 6,095,362

[45] Date of Patent: Aug. 1, 2000

[54] COMBINATION BOX FOR HOLDING ARTICLES MADE OF METALS

[76] Inventor: Chen Shui-Shang, 199, Su Mou Road, Ho Mei Township, Chan Hua Hsien, Taiwan

[21] Appl. No.: 09/272,528

[22] Filed: Mar. 22, 1999

[30] Foreign Application Priority Data

Jul. 23, 1998 [CN] China ..... 87211976

[51] Int. Cl.[7] ..... B65D 21/02; B65D 85/24

[52] U.S. Cl. ..... 220/23.4; 206/338; 220/23.86; 220/23.87; 220/23.89

[58] Field of Search ..... 220/23.4, 23.6, 220/23.86, 23.89, 23.87; 206/338, 223

[56] References Cited

U.S. PATENT DOCUMENTS

| | | | |
|---|---|---|---|
| 4,194,619 | 3/1980 | Schley | 206/217 |
| 4,826,007 | 5/1989 | Skeie | 206/373 |
| 5,007,540 | 4/1991 | Beasley et al. | 220/23.83 |
| 5,135,823 | 8/1992 | Eales | 220/23.4 X |
| 5,139,299 | 8/1992 | Smith | 220/23.4 X |
| 5,213,233 | 5/1993 | Schmitt | 220/23.86 X |

*Primary Examiner*—Allan N. Shoap
*Assistant Examiner*—Joe Merek
*Attorney, Agent, or Firm*—Harrison & Egbert

[57] ABSTRACT

A combination box is intended for use in holding articles of metals and is composed of a main container of a polygonal construction, and a plurality of auxiliary containers which are fastened with the outer walls of the main container. The main container is provided with a protruded edge and a locating piece. The auxiliary containers are removably fastened adjacent the outer walls of the main container between the protruded edge and the locating piece.

2 Claims, 5 Drawing Sheets

COMBINATION BOX FOR HOLDING ARTICLES MADE OF METALS

FIELD OF THE INVENTION

The present invention relates generally to a box for holding articles made of metals, and more particularly to a combination box for holding articles made of metals, such as nails, screws, nuts, bolts, rivets, hooks, etc.

BACKGROUND OF THE INVENTION

A construction worker is often required to carry with him or her a variety of parts of different specifications. In order to enhance the work efficiency of the construction worker, these parts must be carried in a container in an organized manner.

SUMMARY OF THE INVENTION

It is therefore the primary objective of the present invention to provide a combination box for holding articles of metals in an organized manner.

In keeping with the principle of the present invention, the foregoing objective of the present invention is attained by a combination box comprising a main container and a plurality of auxiliary containers which are fastened adjacent the outer walls of the main container. The main container is of a polygonal construction and is provided at the top thereof with a top container. The combination box of the present invention is thus capable of holding a variety of metal parts or pieces in an organized manner.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
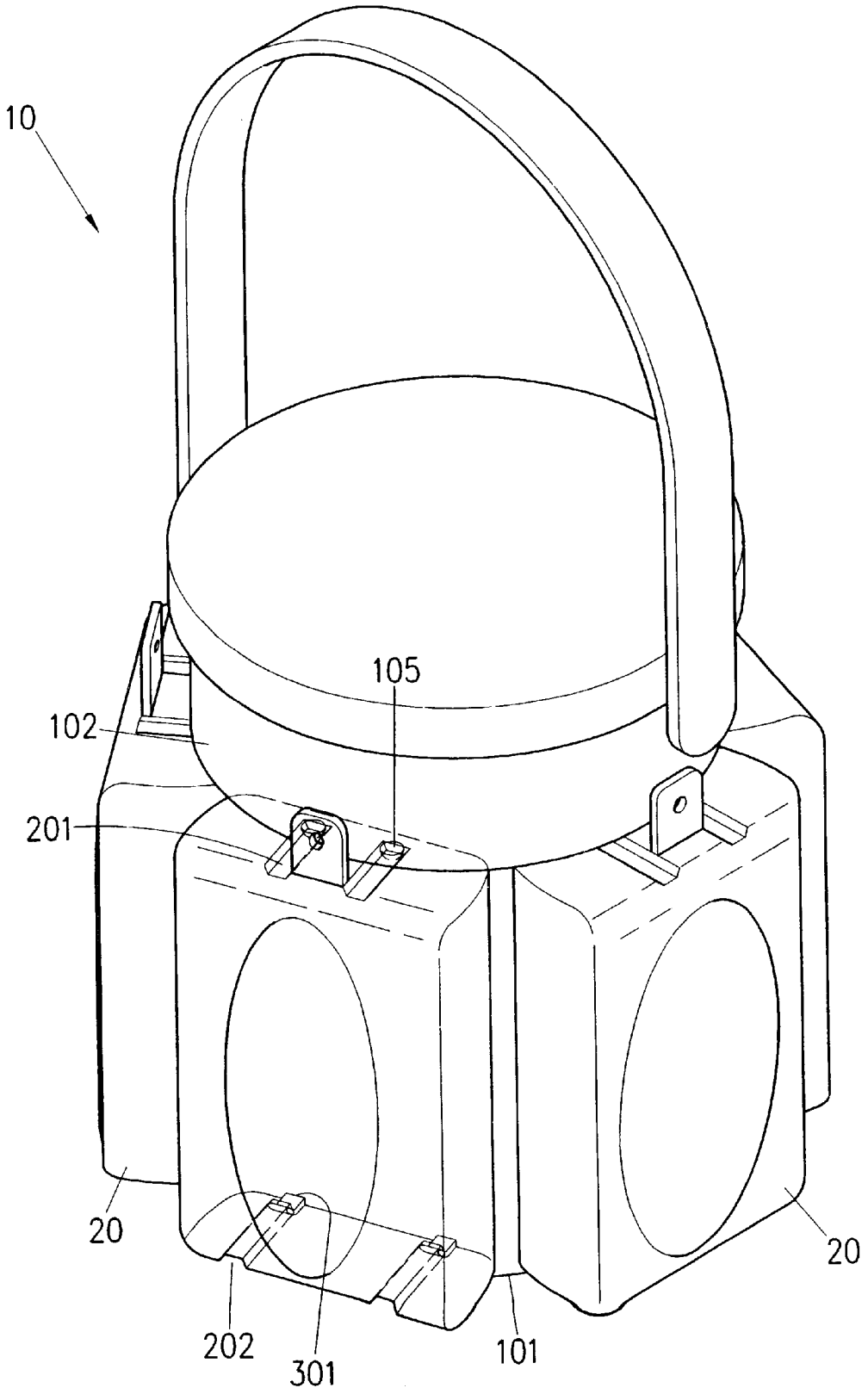
FIG. 1 shows a perspective view of the preferred embodiment of the present invention.
Figure 2:
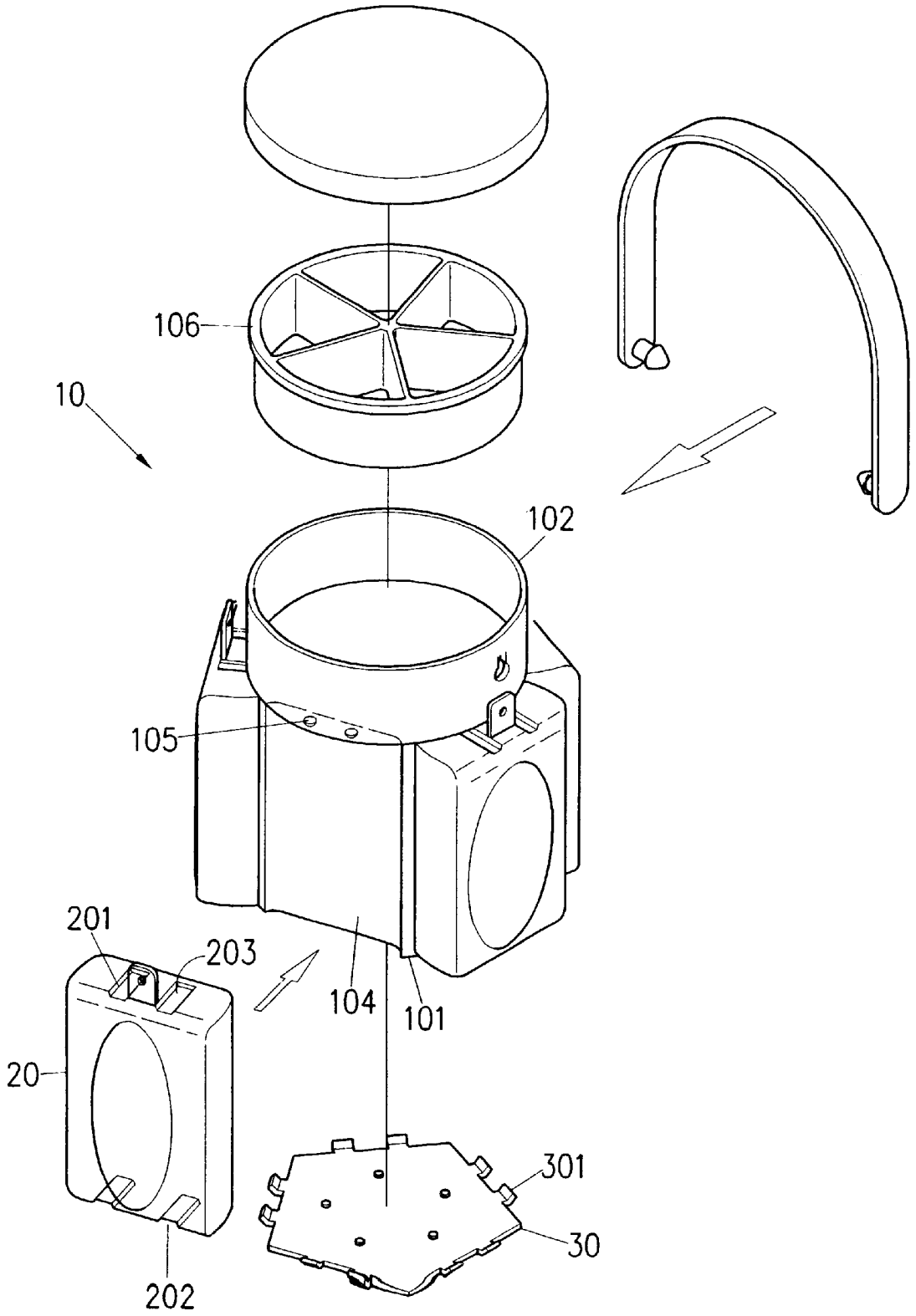
FIG. 2 shows an exploded view of the preferred embodiment of the present invention.

As shown in FIGS. 1 and 2, a combination box embodied in the present invention comprises a main container 10 and a plurality of auxiliary containers 20.

The main container 10 is a polygonal cylindrical body 101 and is provided at the top thereof with a top container 102 which is greater in outer diameter than the body 101. Located at the junction between the top container 102 and the polygonal cylindrical body 101 is a protruded edge 103. The protruded edge 103 extends outward from the outer walls 104 of the body 101.The polygonal cylindrical body 101 is provided at the bottom thereof with a locating piece 30 fastened therewith. The auxiliary containers 20 are fastened adjacent the outer walls 104 of the polygonal cylindrical body 101 by the protruded edge 103 and the locating piece 30. The protruded edge 103 is provided with a plurality of retaining protrusions 105. The locating piece 30 is provided in the periphery thereof with a plurality of retaining hooks The plurality of retaining hooks 301 are arranged to be positioned below the retaining protrusions 105.

The auxiliary containers 20 are provided with a plurality of retaining slots 201 and 202 each having at one end thereof an arresting edge 203. Each auxiliary container 20 is fastened adjacent the outer wall 104 of the polygonal cylindrical body 101 such that the retaining slot 202 recieves the retaining hook 301 of the locating piece 30. The retaining slots 201 of the auxiliary containers 20 respectively receive the retaining protrusions 105 extending downwardly from the protruding edge 103 (as shown in FIG. 3).

The top container 102 is provided with an organizer 106 to facilitate the holding of parts or small hand tools.

Figure 3:
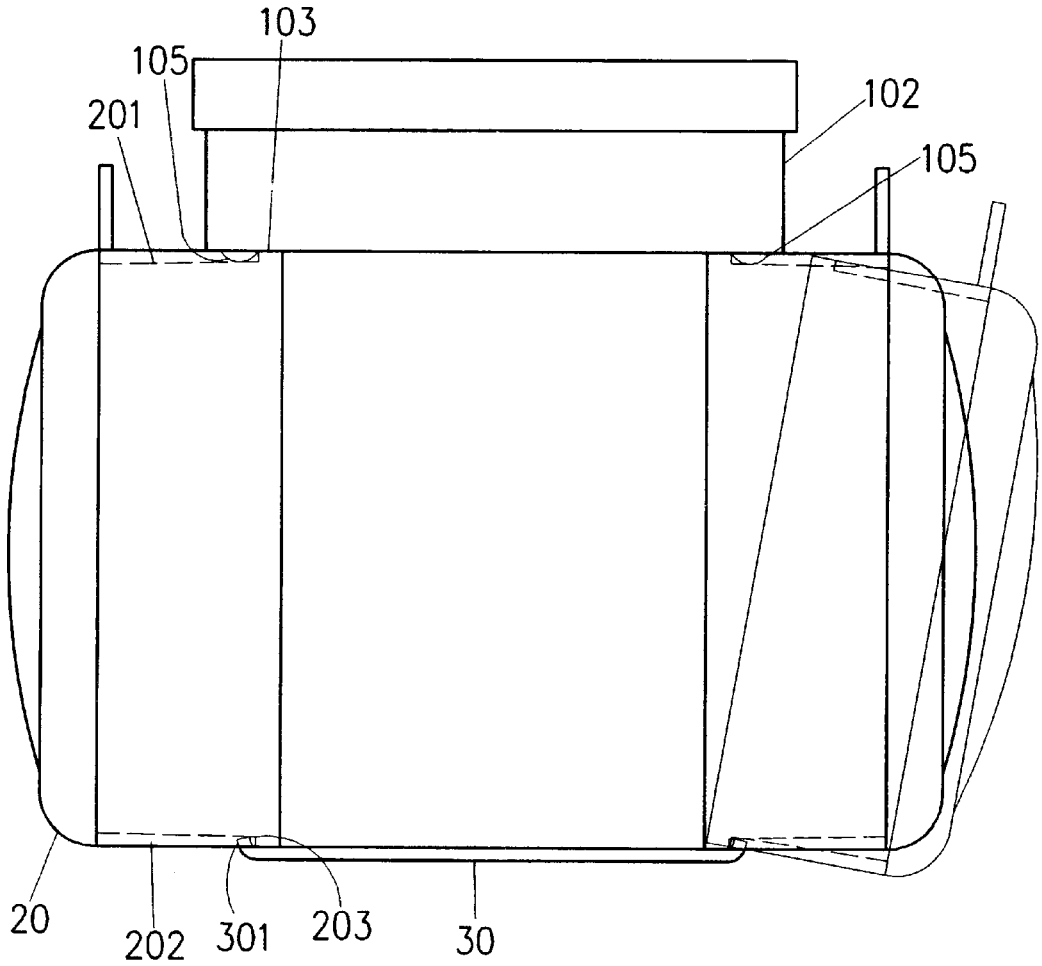
FIG. 3 shows a schematic view of the preferred embodiment of the present invention in use.
Figure 4:
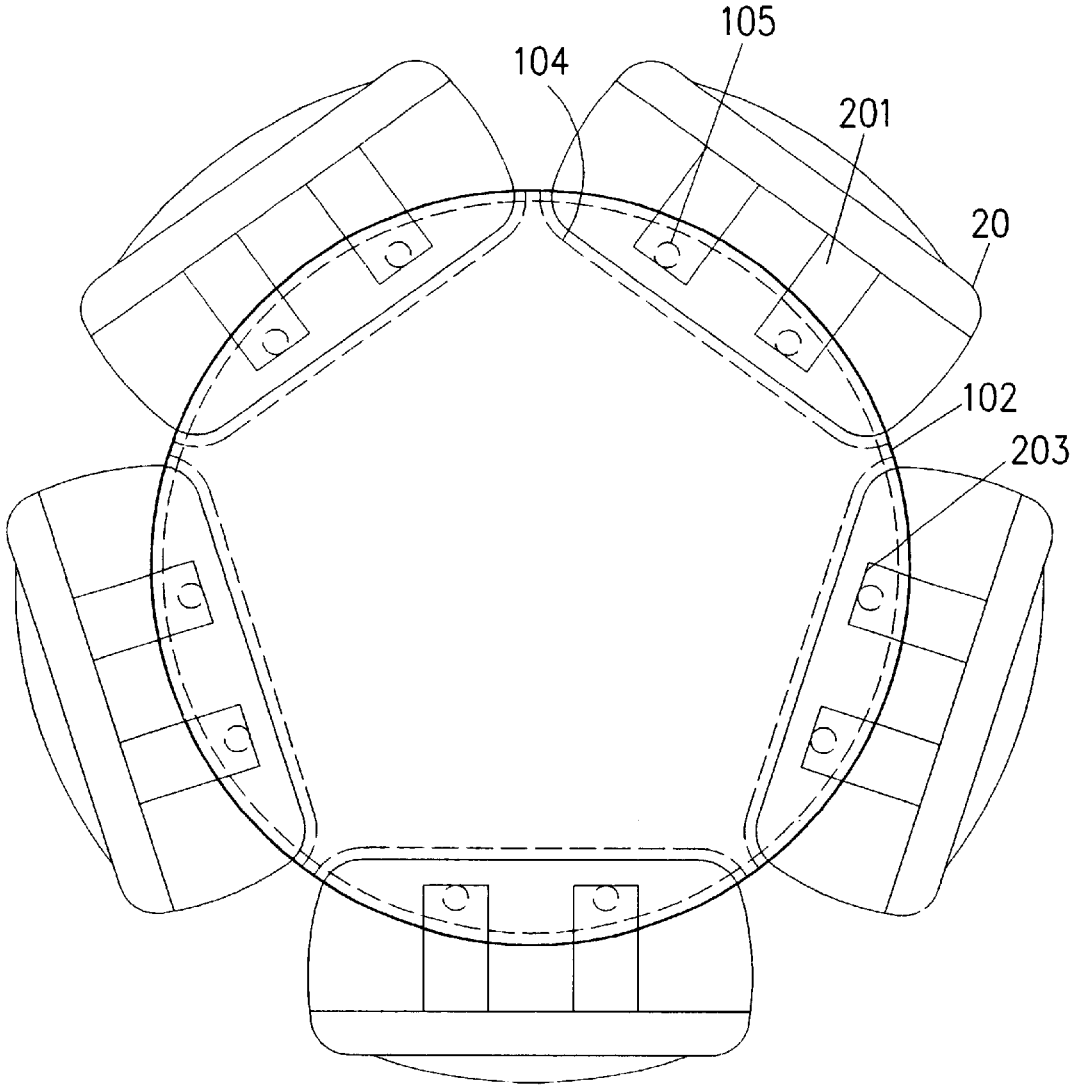
FIG. 4 shows a top plan view of the preferred embodiment of the present invention.
Figure 5:
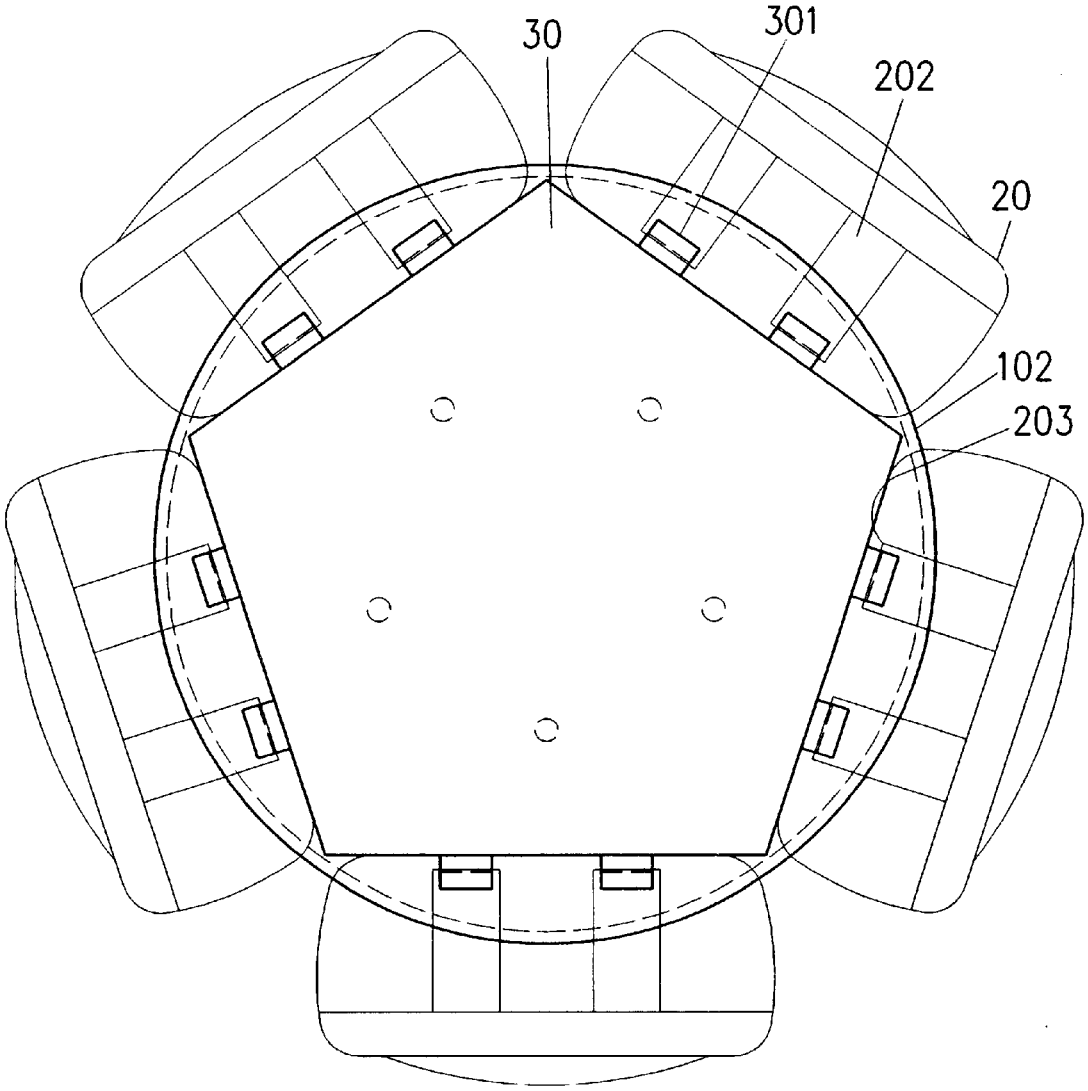
FIG. 5 shows a bottom plan view of the preferred embodiment of the present invention.

As shown in FIGS. 3, 4, and 5, the top of each auxiliary container 20 can be pulled outwards to cause the retaining protrusions 105 to disengage from retaining slot 201 of the auxiliary container 20. Thereafter, the auxiliary container 20 is pulled upwards to cause the retaining hook 301 of the locating piece 30 to disengage from retaining slot 202 of the auxiliary container 20. As a result, each auxiliary container 20 can be separted from the main container 10. This allows the parts in the auxiliary container 20 to be easily removed form a more accessible location.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A combination box comprising:

a main container having a polygonal cylindrical body, said polygonal cylindrical body having a number of outer walls, said main container having a top container affixed onto said polygonal cylindrical body, said top container defining a protruding edge at a junction of said top container and said polygonal cylindrical body, said polygonal cylindrical body having a locating piece affixed to a bottom thereof, said protruding edge having a plurality of retaining protrusions extending downwardly therefrom, said locating piece having a plurality of retaining hooks formed at a periphery thereof, said plurality of retaining hooks positioned below said plurality of retaining protrusions and extending outwardly of said polygonal cylindrical body; and a plurality of auxiliary containers equal in number to a number of outer walls of said polygonal cylindrical body, each of said plurality of auxiliary containers having a plurality of retaining slots formed thereon, each of said plurality of retaining slots having an arresting edge, each of said plurality of auxiliary containers being fastened adjacent a respective outer wall of said polygonal cylindrical body such that said retaining slots receive said retaining hooks and said retaining protrusions.

2. The combination box of claim 1, wherein said top container has multiple compartments therein.

* * * * *